US005975212A

United States Patent [19]

Johnston

[11] Patent Number: 5,975,212

[45] Date of Patent: Nov. 2, 1999

[54] SURFACE CONTROLLED SUBSURFACE SAFETY VALVE DOWNSTOP SEAL

[75] Inventor: Russell A. Johnston, Alvin, Tex.

[73] Assignee: Camco International Inc., Houston, Tex.

[21] Appl. No.: 09/293,043

[22] Filed: Apr. 16, 1999

Related U.S. Application Data

[60] Provisional application No. 60/082,383, Apr. 20, 1998.

[51] Int. Cl.[6] ..... E21B 34/10

[52] U.S. Cl. ..... 166/386; 166/332.8; 137/629

[58] Field of Search ..... 166/332.8, 321, 166/356; 137/629; 251/63.6, 63.5, 359, 363

[56] References Cited

U.S. PATENT DOCUMENTS 4,293,038 10/1981 Evans ..... 137/629
4,527,630 7/1985 Pringle .
4,716,969 1/1988 Pringle .
5,125,457 6/1992 Meaders .
5,503,229 4/1996 Hill, Jr. et al. .
5,598,864 2/1997 Johnston et al. ..... 166/332.8

*Primary Examiner*—William Neuder
*Attorney, Agent, or Firm*—Tobor, Goldstein & Healey, LLP

[57] ABSTRACT

In a broad aspect, the invention relates to an improved downstop seal for use with a rod-piston actuator of a surface controlled subsurface safety valve, wherein the rod-piston actuator has a beveled shoulder formed thereon. The improved downstop seal has a resilient, primary, sealing member having a beveled sealing surface to matingly engage with a portion of the beveled shoulder of the rod-piston actuator; and further has a non-resilient, secondary, sealing member having a beveled sealing surface to matingly engage with a portion of the beveled shoulder of the rod-piston actuator.

20 Claims, 3 Drawing Sheets

SURFACE CONTROLLED SUBSURFACE SAFETY VALVE DOWNSTOP SEAL

RELATED APPLICATIONS

This application claims the benefit of U.S. Provisional Application No. 60/082,383, filed Apr. 20, 1998.

BACKGROUND OF THE INVENTION

1. Field of the Invention

The present invention relates generally to a combination resilient and non-resilient downstop seal for use within a surface controlled subsurface safety valve.

2. Description of the Related Art

Subsurface safety valves are commonly used in wells to prevent uncontrolled fluid flow through the well in the event of an emergency, such as to prevent a well blowout. Conventional safety valves use a flapper, which is biased by a spring to a normally closed position, but is retained in an open position by the application of hydraulic fluid operating on a rod piston connected to the flapper valve from the earth's surface. A typical surface controlled subsurface safety valve ("SCSSV") is shown and described in U.S. Pat. No. 4,161,219, which is commonly assigned hereto.

Previous subsurface safety valves typically incorporate either a non-resilient seal such as a metal-to-metal seal or some type of resilient, or yieldable, seal such as an elastomeric or a non-elastomeric, plastic, seal to seal the rod piston actuator within the hydraulic actuation chamber when the subsurface safety valve is in an open position. Elastomeric seals have proven to be undesirable in certain applications wherein dissolved gases may be introduced into the elastomeric seals, which can cause an explosive decompression of the elastomeric seal from a sudden release of pressure upon opening of the safety valve, thus destroying the elastomeric seal during operation. Non-resilient metal-to-metal seals have proven to be generally reliable, although they may not provide a suitable seal in certain applications, and may permit some fluid to pass through the seal, particularly when debris is introduced into the seal creating a leak path, thus causing some leakage to occur. Non-elastomeric seals will generally provide a sufficient seal, but they may be less reliable than metal-to-metal seals in particular applications.

The necessary selection between the use of metal-to-metal seals and resilient, or yieldable, seals have not previously provided an adequate sealing solution for existing SCSSV downstops. Accordingly, there has developed a need to provide a combination non-resilient and resilient, sealing assembly to provide the benefits of both a non-resilient seal and a resilient seal in a single sealing assembly. The present invention has been contemplated to meet this need.

SUMMARY OF THE INVENTION

In a broad aspect, the invention is an improved downstop seal for use with a rod-piston actuator of a surface controlled subsurface safety valve, the rod-piston actuator having a beveled shoulder formed thereon, comprising: a resilient, primary, sealing member having a beveled sealing surface to matingly engage with a portion of the beveled shoulder of the rod-piston actuator; and a non-resilient, secondary, sealing member having a beveled sealing surface to matingly engage with a portion of the beveled shoulder of the rod-piston actuator. Another feature of this aspect of the present invention is that the resilient sealing member is comprised of a non-metallic and non-elastomeric material. Another feature of this aspect of the present invention is that the resilient sealing member is comprised of at least one of polyetherketone (PEK), polyetheretherketone (PEEK), polyetherketoneetherketoneketone (PEKEKK), polyamide, polyethylene terephthalate (PET), polysulphone, epoxy, polyester, polyether, and polyketone. Another feature of this aspect of the present invention is that the resilient and non-resilient sealing members are coplanar. Another feature of this aspect of the present invention is that the non-resilient sealing member is spaced apart from the beveled shoulder on the rod-piston actuator upon initial contact between the resilient sealing member and the beveled shoulder on the rod-piston actuator. Another feature of this aspect of the present invention is that the beveled shoulder on the rod-piston actuator and the beveled sealing surface of the resilient sealing surface are not parallel such that the beveled sealing surface of the resilient sealing surface includes an initial sealing point, whereby, upon downward movement of the rod-piston actuator, the initial sealing point will contact the beveled shoulder on the rod-piston actuator before any other point on the beveled sealing surface of the resilient sealing surface contacts the beveled shoulder on the rod-piston actuator. Another feature of this aspect of the present invention is that the seal may further include a centralizer bushing disposed between the rod-piston actuator and the non-resilient sealing member. Another feature of this aspect of the present invention is that the beveled shoulder on the rod-piston actuator is metal.

In another aspect, the invention may be in a surface-controlled subsurface safety valve having body, the body having a longitudinal bore therethrough, a valve closure member movably disposed to control fluid flow through the longitudinal bore, and a rod-piston actuator disposed for reciprocal movement within a bore in a sidewall of the body, the rod-piston being remotely shiftable to open and close the valve closure member and having a beveled shoulder, an improved downstop seal comprising: a resilient, primary, sealing member having a beveled sealing surface to matingly engage with a portion of the beveled shoulder of the rod-piston actuator, the resilient sealing member being disposed within the sidewall bore and about the rod-piston actuator; and a non-resilient, secondary, sealing member having a beveled sealing surface to matingly engage with a portion of the beveled shoulder of the rod-piston actuator, the non-resilient sealing member being disposed within the sidewall bore and about the rod-piston actuator. Another feature of this aspect of the present invention is that the resilient sealing member is comprised of a non-metallic and non-elastomeric material. Another feature of this aspect of the present invention is that the resilient sealing member is comprised of at least one of polyetherketone (PEK), polyetheretherketone (PEEK), polyetherketoneetherketoneketone (PEKEKK), polyamide, polyethylene terephthalate (PET), polysulphone, epoxy, polyester, polyether, and polyketone. Another feature of this aspect of the present invention is that the resilient and non-resilient sealing members are coplanar. Another feature of this aspect of the present invention is that the non-resilient sealing member is spaced apart from the beveled shoulder on the rod-piston actuator upon initial contact between the resilient sealing member and the beveled shoulder on the rod-piston actuator. Another feature of this aspect of the present invention is that the beveled shoulder on the rod-piston actuator and the beveled sealing surface of the resilient sealing surface are not parallel such that the beveled sealing surface of the resilient sealing surface includes an initial sealing point, whereby, upon downward movement of the rod-piston actuator, the initial sealing point will contact the beveled shoulder on the rod-piston actuator before any other point on the beveled sealing surface of the resilient sealing surface contacts the beveled shoulder on the rod-piston actuator. Another feature of this aspect of the present invention is that the seal may further include a centralizer bushing disposed between the rod-piston actuator and the non-resilient sealing member. Another feature of this aspect of the present invention is that the beveled shoulder on the rod-piston actuator is metal.

In another aspect, the invention may be a method of preventing fluid leakage past a beveled shoulder of a rod-piston actuator within a bore in a sidewall of a subsurface safety valve, the method comprising: positioning a resilient, primary, sealing member having a beveled sealing surface within the sidewall bore; positioning a non-resilient, secondary, sealing member having a beveled sealing surface within the sidewall bore adjacent the resilient sealing member; and moving the beveled shoulder of the rod-piston actuator into sealing engagement with the resilient and non-resilient sealing members. Another feature of this aspect of the present invention is that the moving step includes contacting the beveled shoulder on the rod-piston with the beveled sealing surface on the resilient sealing member before contacting the beveled shoulder on the rod-piston with the beveled sealing surface on the non-resilient sealing member. Another feature of this aspect of the present invention is that the method may further include contacting the beveled shoulder on the rod-piston with an initial sealing point on the beveled sealing surface on the resilient sealing member before contacting any other point on the beveled sealing surface on the resilient sealing member. Another feature of this aspect of the present invention is that the method may further include positioning a centralizer bushing between the rod-piston actuator and the non-resilient sealing member.

While the invention will be described in connection with the preferred embodiments, it will be understood that it is not intended to limit the invention to those embodiments. On the contrary, it is intended to cover all alternatives, modifications, and equivalents as may be included within the spirit and scope of the invention as defined by the appended claims.

DETAILED DESCRIPTION OF THE INVENTION

Figure 1:
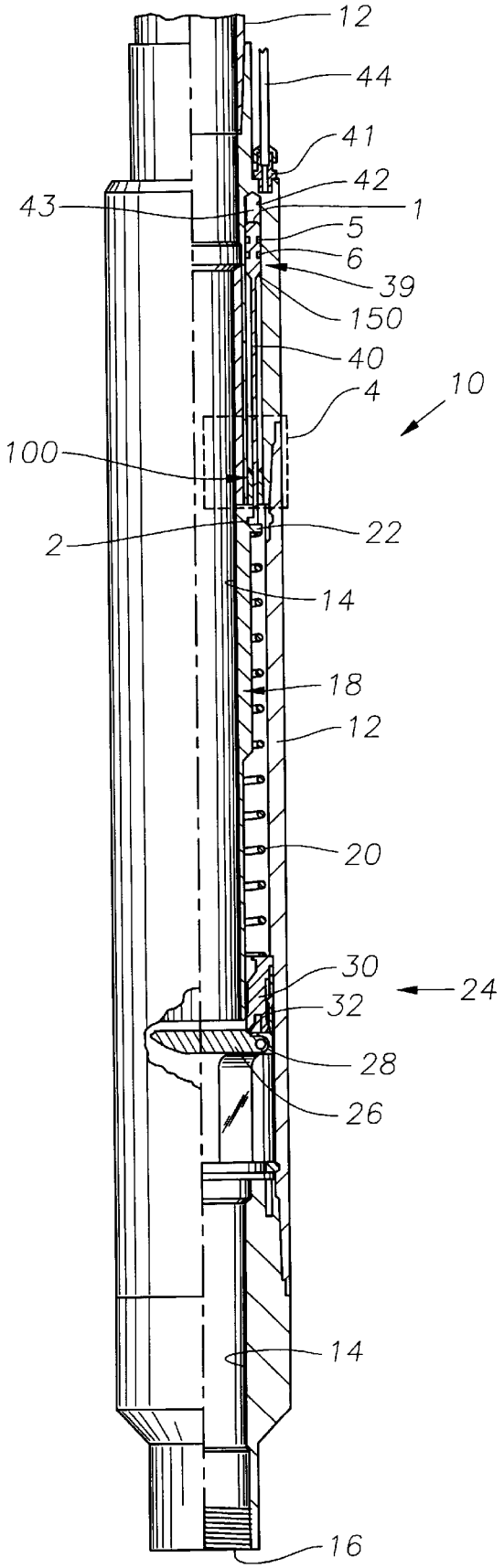
FIG. 1 is an elevational side view, partially in cross-section, showing a surface controlled subsurface safety valve with a downstop seal of the present invention.

Referring to FIG. 1, a surface controlled subsurface safety valve ("SCSSV") 10 of the present invention is shown generally having a tubular body 12 with a longitudinal bore 14 that extends therethrough. Each end of the body 12 include mechanisms, such as threads 16 for interconnection with a pipe string (not shown) suspended within a wellbore. A sleeve member 18, usually referred to as a flow tube 18, is disposed within the bore 14 and is adapted for axial movement therein. The flow tube 18 may include a spring 20 disposed therearound that may act upon a shoulder 22 on the flow tube 18 to bias the flow tube 18 away from a flapper mechanism 24 or other suitable safety valve mechanism.

The flapper mechanism 24 generally comprises a disc or flapper valve closure member 26, including an annular sealing surface 32 on the flapper 26. A rod-piston system 39 is provided to open the flapper 26, and is generally comprised of a rod-piston 40 sealably mounted for reciprocal movement within a bore 42 located within the wall of the tubular body 12. A first end 1 of the rod-piston 40 is in contact with hydraulic fluid provided thereto from the earth's surface through a relatively small diameter control conduit 44 in fluid communication with hydraulic port 41 provided in fluid communication with hydraulic chamber 43 formed by bore 42. A second end 2 of the rod-piston 40 is operatively connected to the flow tube 18. When the pressure of the hydraulic fluid in the control conduit 44 exceeds the force needed to open the flapper valve 26, the rod-piston 40 reciprocates within the hydraulic chamber 43 to move the flow tube 18 into contact with the flapper 26 and thereby open the flapper 26 in an opened position (not shown). In the event that the hydraulic pressure applied to the rod-piston 40 is decreased, as by command from the earth's surface or by the control conduit 44 being damaged, the rod-piston 40 reciprocates to a closed position (FIGS. 2, 3), permitting the flapper 26 to be rotated into a closed position (FIG. 1) by action of, for example, a hinge spring (not shown) to effectively seal the flapper valve 26.

Figure 2:
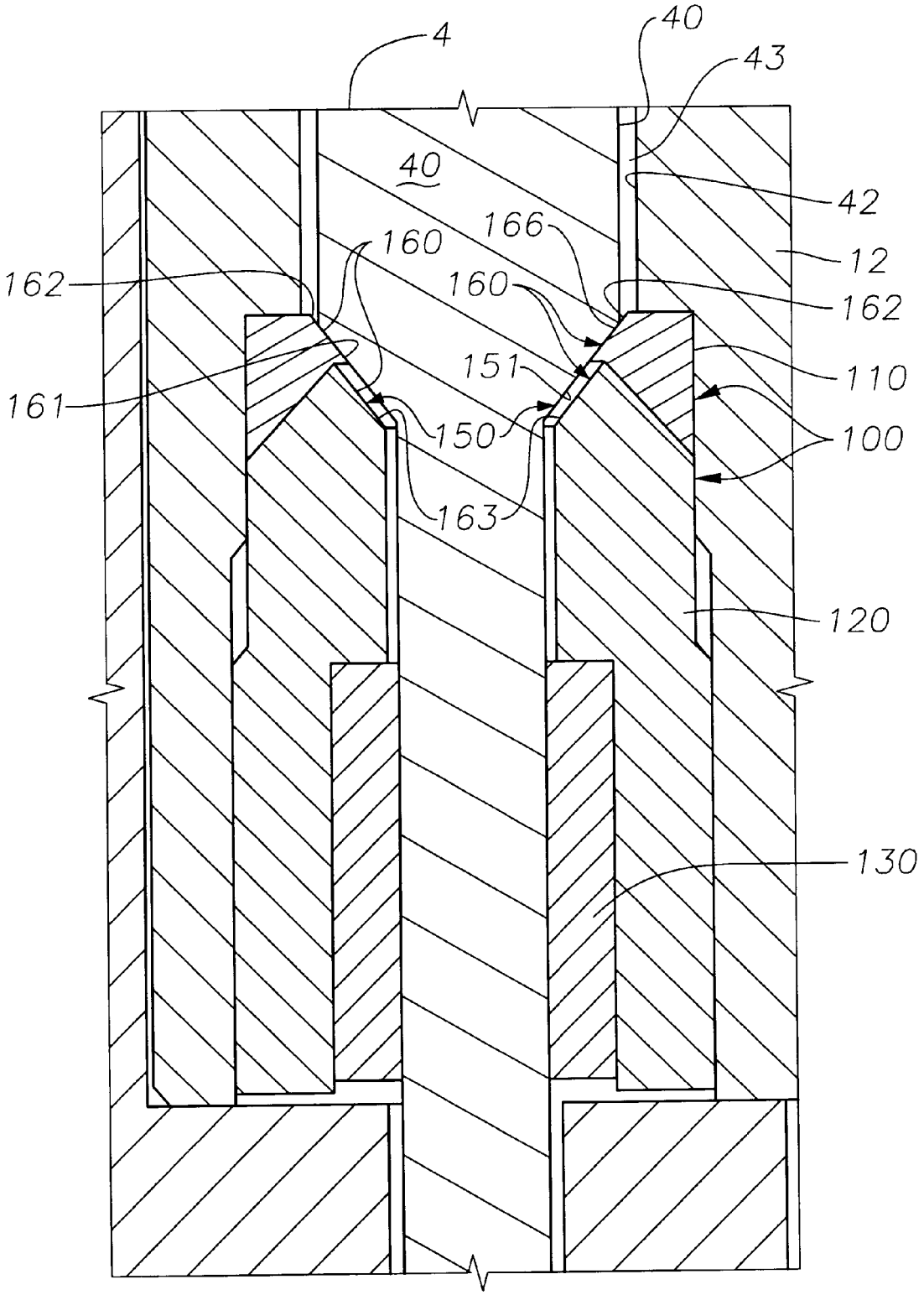
FIG. 2 is an exploded fragmentary elevational view of an embodiment of the downstop seal of the present invention shown by dotted line 4 of FIG. 1.
Figure 3:
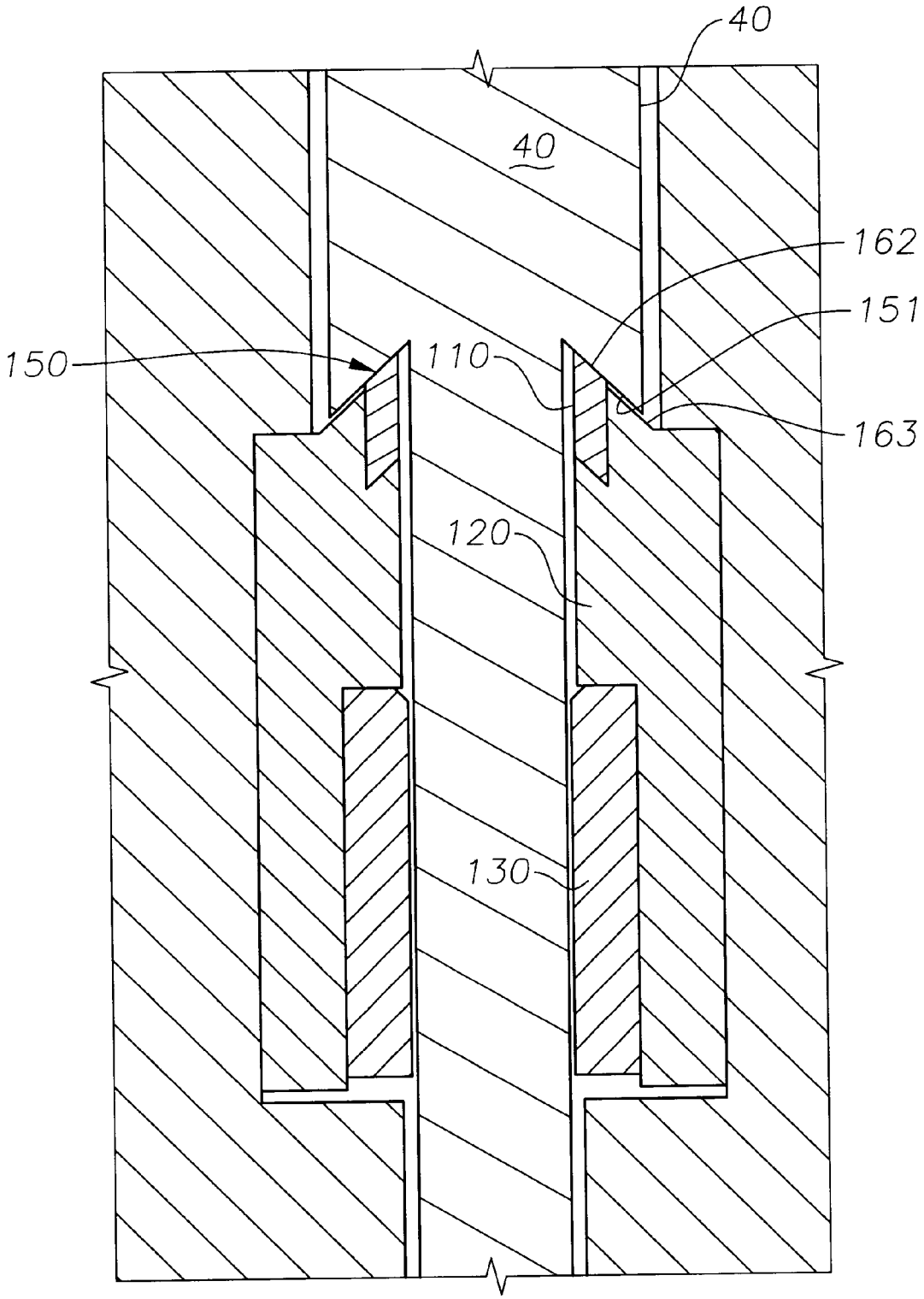
FIG. 3 is an exploded fragmentary elevational view of an embodiment of the downstop seal of the present invention shown by dotted line 4 of FIG. 1.

Referring now to FIG. 2, an enlarged view of a downstop seal portion 4 of the rod-piston system 39 is shown. Downstop seal 100 of the present invention includes rod-piston 40, which is shown sealably mounted for reciprocal movement within bore 42 located within the wall of the tubular body 12 and hydraulic chamber formed thereby 43. Rod-piston 40 may also comprise sealing members 5, 6 (FIG. 1) for sealing rod-piston 40 during actuation of the rod-piston actuator by, for example, the hydraulic pressure provided through conduit 44. Such seals are typically not perfect seals and, although they generally provide a sufficient seal for use during actuation of the rod-piston actuator 40, they may not provide sufficient sealing for use during production operations. Downstop seal 100 is typically provided, therefore, to provide a secure seal for use during such production operations. Downstop seal 100 may be disposed in a lower portion 4 of hydraulic chamber 43 in a ring-like fashion around rod-piston 40, having a beveled profile 160 to provide a suitable landing for a beveled profile 150 provided on rod-piston 40 for mating engagement with downstop seal 100. Rod-piston 40 is disposed through downstop seal 100 for reciprocal movement within and sealing engagement with downstop seal 100.

In operation, as hydraulic pressure is provided to hydraulic chamber 43, rod-piston 40 is caused to reciprocate within hydraulic chamber 43 and downstop seal 100 to the open position shown, whereby mating beveled surfaces 150,160 provided on rod-piston 40 and downstop seal 100, respectfully, provide a secure sealing engagement of the rod-piston 40 within hydraulic chamber 43.

The improved downstop seal 100 of the present invention generally comprises a primary sealing member 110, which in a preferred embodiment is a resilient sealing member 110. The improved downstop seal 100 of the present invention further comprises a secondary sealing member 120, which in a preferred embodiment is a non-resilient sealing member 120. The non-resilient sealing member 120 is preferably press fit within the body 12 to seal the space therebetween. Downstop seal 100 may further comprise a centralizer bushing 130 to centralize the rod-piston 40 within the downstop seal 100 as rod-piston 40 reciprocates within downstop seal 100 and to assist in the orientation of the mating surface 151 of rod-piston 40 with respect to mating surface 161 of downstop seal 100 as the rod-piston 40 abuts downstop seal 100 to improve the sealing reliability of the downstop seal 100.

In a preferred embodiment, mating surface 161 of downstop seal 100 and mating surface 151 of rod-piston 40 are similarly tapered. Mating surfaces 161,151 of downstop seal 100 and rod-piston 40, respectively, are, therefore, provided to matingly engage with one another. Accordingly, mating surface 161 of downstop seal 100 generally provides a landing 160 for mating engagement with a shoulder 150 of rod-piston 40 provided by mating surface 151 of downstop seal 100.

The downstop seal mating surface 161, is comprised of a primary sealing surface 162 and a secondary sealing surface 163. Primary sealing surface 162 is provided by a resilient primary sealing member 110 of the present invention to provide a primary seal. Secondary sealing surface 163 is provided by a non-resilient secondary sealing member 120 to provide a secondary seal. It should also be noted, however, that in a particular embodiment such as that shown in FIG. 3, a variety of landing/shoulder shapes and configurations may be utilized.

A variety of resilient, or yieldable, materials could be used for resilient primary sealing member 110, which may be referred to herein as the "soft seat", so long as the material selected provides a sealing surface that is generally deformable with respect to the non-resilient secondary, sealing member 120. An example of a material suitable for the soft seat 110 is a material made of a polyether known as polyetheretherketone (PEEK), which may be known in the art under trade names Victrex or Zyex. However, it should be noted that other materials could be used so long as they are generally resilient, or deformable, with respect to the secondary sealing member 120. Other resilient, non-metallic, non-elastomeric materials referred to herein may be formed from polyetherketone (PEK), polyetheretherketone (PEEK), polyetherketoneetherketoneketone (PEKEKK), polyamides, polyethylene terephthalates (PET), polysulphones, epoxies, polyesters, polyethers, polyketones, and other polymerizable combinations thereof.

The rod-piston 40 and sealing surface 151 formed thereon are preferably metal; and the secondary sealing member 120, which may be referred to herein as the "hard seat," is also preferably metal. It should be noted, however, that neither the rod-piston 40 nor the secondary sealing member 120 may be metal in a particular embodiment. Instead, the rod-piston 40 may be manufactured from a variety of materials and the hard seat, or secondary sealing member 120 may be manufactured using materials that are generally not deformable with respect to the primary, resilient, seal while still providing sufficient hardness to provide the reliability of a metal-to-metal sealing surface. Further, in an embodiment not shown, like downstop seal 100, the shoulder 150 of the rod-piston 40 may also include a resilient portion, in which case the downstop seal could be made entirely from non-resilient material or it could also include a resilient material portion to mate with the resilient portion of the rod-piston.

In a preferred embodiment, the sealing surfaces 162, 163 of resilient, primary, sealing member 110 and non-resilient, secondary, sealing member 120, respectively, may be shaped and sized such that a portion of the sealing surface 162 of resilient, primary, sealing member 110 extends beyond and is therefore not coplanar with the sealing surface 163 of non-resilient, secondary, sealing member 120. It should be noted that sealing surfaces 151, 162, and 163 are bearing surfaces and provide a positive seal when downward sealing force is applied to rod-piston 40. Accordingly, as rod-piston 40 is lowered within downstop seal 100, a portion of the sealing surface 151 of rod-piston shoulder 150 will first contact resilient, primary, sealing member 100. Thereafter, subsequent sealing force provided by hydraulic pressure acting upon rod-piston 40 within hydraulic chamber 43 will cause rod-piston 40 to create an initial seating force to initially deform resilient, primary, sealing member 110 until the shoulder 150 matingly engages with sealing surface 162 of non-deformable, secondary, sealing member 120 of downstop seal 40. Further hydraulic pressure is thereafter provided to provide a secure and positive seal between downstop seal 100 and rod-piston 40 with mating engagement therebetween. Hydraulic pressure may then be maintained within hydraulic chamber 43 to maintain the mating engagement of the rod-piston 40 with downstop seal 100.

In a particular embodiment, the profile of the sealing surface 162 of resilient, primary, sealing member 110 may be coplanar to that of the sealing surface 163 of non-resilient, secondary, sealing member 120. Alternatively, the profile of sealing surface 162 may have an angle greater than that of the sealing surface 163 of non-resilient, secondary, sealing member 120 and the corresponding profile on rod-piston shoulder 151 such that an initial sealing point 166 is provided on sealing surface 162 of the resilient, primary, seal member 110. In such an embodiment, the rod-piston shoulder 150 will initially contact the sealing surface 162 of resilient, primary, sealing member 110 at an initial sealing point 166 located on sealing surface 162. The deformation of resilient, primary, sealing member 110 caused by subsequent downward seating force provided by rod-piston 40 will cause initial deformation of resilient, primary, sealing member 110 such that the remaining sealing surface 162 of resilient, primary, sealing member 110 will be engaged by a portion of mating surface 151 of rod-piston shoulder profile 150. In such an embodiment, a sealing gradient may be provided to ensure an adequate sealing force between rod-piston shoulder 150 and the resilient, primary, sealing member 110 of downstop seal 100, while maintaining non-resilient secondary, sealing, member 120 in sealing engagement with the rod-piston shoulder 150.

It is to be understood that the invention is not limited to the exact details of construction, operation, exact materials or embodiments shown and described, as obvious modifications and equivalents will be apparent to one skilled in the art. Accordingly, the invention is therefore to be limited only by the scope of the appended claims.

I claim:

1. An improved downstop seal for use with a rod-piston actuator of a surface controlled subsurface safety valve, the rod-piston actuator having a beveled shoulder formed thereon, comprising:

a resilient, primary, sealing member having a beveled sealing surface to matingly engage with a portion of the beveled shoulder of the rod-piston actuator; and a non-resilient, secondary, sealing member having a beveled sealing surface to matingly engage with a portion of the beveled shoulder of the rod-piston actuator.

2. The improved downstop seal of claim 1, wherein the resilient sealing member is comprised of a non-metallic and non-elastomeric material.

3. The improved downstop seal of claim 1, wherein the resilient sealing member is comprised of at least one of polyetherketone (PEK), polyetheretherketone (PEEK), polyetherketoneetherketoneketone (PEKEKK), polyamide, polyethylene terephthalate (PET), polysulphone, epoxy, polyester, polyether, and polyketone.

4. The improved downstop seal of claim 1, wherein the resilient and non-resilient sealing members are coplanar.

5. The improved downstop seal of claim 1, wherein the non-resilient sealing member is spaced apart from the beveled shoulder on the rod-piston actuator upon initial contact between the resilient sealing member and the beveled shoulder on the rod-piston actuator.

6. The improved downstop seal of claim 1, wherein the beveled shoulder on the rod-piston actuator and the beveled sealing surface of the resilient sealing surface are not parallel such that the beveled sealing surface of the resilient sealing surface includes an initial sealing point, whereby, upon downward movement of the rod-piston actuator, the initial sealing point will contact the beveled shoulder on the rod-piston actuator before any other point on the beveled sealing surface of the resilient sealing surface contacts the beveled shoulder on the rod-piston actuator.

7. The improved downstop seal of claim 1, further including a centralizer bushing disposed between the rod-piston actuator and the non-resilient sealing member.

8. The improved downstop seal of claim 1, wherein the beveled shoulder on the rod-piston actuator is metal.

9. In a surface-controlled subsurface safety valve having body, the body having a longitudinal bore therethrough, a valve closure member movably disposed to control fluid flow through the longitudinal bore, and a rod-piston actuator disposed for reciprocal movement within a bore in a sidewall of the body, the rod-piston being remotely shiftable to open and close the valve closure member and having a beveled shoulder, an improved downstop seal comprising:

a resilient, primary, sealing member having a beveled sealing surface to matingly engage with a portion of the beveled shoulder of the rod-piston actuator, the resilient sealing member being disposed within the sidewall bore and about the rod-piston actuator; and a non-resilient, secondary, sealing member having a beveled sealing surface to matingly engage with a portion of the beveled shoulder of the rod-piston actuator, the non-resilient sealing member being disposed within the sidewall bore and about the rod-piston actuator.

10. The improved downstop seal of claim 9, wherein the resilient sealing member is comprised of a non-metallic and non-elastomeric material.

11. The improved downstop seal of claim 9, wherein the resilient sealing member is comprised of at least one of polyetherketone (PEK), polyetheretherketone (PEEK), polyetherketoneetherketoneketone (PEKEKK), polyamide, polyethylene terephthalate (PET), polysulphone, epoxy, polyester, polyether, and polyketone.

12. The improved downstop seal of claim 9, wherein the resilient and non-resilient sealing members are coplanar.

13. The improved downstop seal of claim 9, wherein the non-resilient sealing member is spaced apart from the beveled shoulder on the rod-piston actuator upon initial contact between the resilient sealing member and the beveled shoulder on the rod-piston actuator.

14. The improved downstop seal of claim 9, wherein the beveled shoulder on the rod-piston actuator and the beveled sealing surface of the resilient sealing surface are not parallel such that the beveled sealing surface of the resilient sealing surface includes an initial sealing point, whereby, upon downward movement of the rod-piston actuator, the initial sealing point will contact the beveled shoulder on the rod-piston actuator before any other point on the beveled sealing surface of the resilient sealing surface contacts the beveled shoulder on the rod-piston actuator.

15. The improved downstop seal of claim 9, further including a centralizer bushing disposed between the rod-piston actuator and the non-resilient sealing member.

16. The improved downstop seal of claim 9, wherein the beveled shoulder on the rod-piston actuator is metal.

17. A method of preventing fluid leakage past a beveled shoulder of a rod-piston actuator within a bore in a sidewall of a subsurface safety valve, the method comprising:

positioning a resilient, primary, sealing member having a beveled sealing surface within the sidewall bore;

positioning a non-resilient, secondary, sealing member having a beveled sealing surface within the sidewall bore adjacent the resilient sealing member; and moving the beveled shoulder of the rod-piston actuator into sealing engagement with the resilient and non-resilient sealing members.

18. The method of claim 17, wherein the moving step includes:

contacting the beveled shoulder on the rod-piston with the beveled sealing surface on the resilient sealing member before contacting the beveled shoulder on the rod-piston with the beveled sealing surface on the non-resilient sealing member.

19. The method of claim 18, further including contacting the beveled shoulder on the rod-piston with an initial sealing point on the beveled sealing surface on the resilient sealing member before contacting any other point on the beveled sealing surface on the resilient sealing member.

20. The method of claim 17, further including positioning a centralizer bushing between the rod-piston actuator and the non-resilient sealing member.

* * * * *